US006193423B1

(12) United States Patent
Takahashi

(10) Patent No.: US 6,193,423 B1
(45) Date of Patent: Feb. 27, 2001

(54) DEVICE FOR MONITORING A SHEET MATERIAL AND METHOD FOR MONITORING A SHEET MATERIAL BY USING THE DEVICE

(75) Inventor: Shinichi Takahashi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/281,323

(22) Filed: Mar. 30, 1999

(30) Foreign Application Priority Data

Mar. 31, 1998 (JP) ..... 10-087733

(51) Int. Cl.[7] ..... G03D 13/00
(52) U.S. Cl. ..... 396/567; 396/568; 355/40
(58) Field of Search ..... 355/68, 40, 41; 396/568–570

(56) References Cited

U.S. PATENT DOCUMENTS 4,603,956 * 8/1986 Baker ..... 396/568
5,519,483 * 5/1996 Kawanishi et al. ..... 355/75
5,953,104 * 9/1999 Matsumoto ..... 355/40

* cited by examiner

*Primary Examiner*—D. Rutledge
(74) *Attorney, Agent, or Firm*—Sughrue, Mion, Zinn, Macpeak & Seas, PLLC

(57) ABSTRACT

A device for monitoring a sheet material which device is used for a conveying apparatus for conveying sheet materials along a prescribed conveying path, said device comprising: a photoelectric conversion element which has a linear detecting area and outputs values which varies in accordance with an amount of light received at the detecting area, the amount of light changing due to the passage of a sheet material along the conveying path; and recognizing means which recognizes a position of a transverse direction end portion of the sheet material on the basis of a value output by the photoelectric conversion element. By disposing the edge of one half portion of the detecting area of the photoelectric conversion element at a reference position of each sheet material such as a central position of the sheet materials, a change in a width of the sheet material and even a minute amount of meandering of the sheet material can be reliably detected, and the width and a type of the sheet material can be recognized.

18 Claims, 6 Drawing Sheets

F I G. 4

174

| SIGNAL PATTERN | SIZE |
|---|---|
| (1) (5) | 110 SIZE |
| (2) (6) | APS SIZE |
| (3) (7) | 135 SIZE |
| (4) (8) | 110 SIZE |
| | |

DEVICE FOR MONITORING A SHEET MATERIAL AND METHOD FOR MONITORING A SHEET MATERIAL BY USING THE DEVICE

BACKGROUND OF THE INVENTION

1. Field of the Invention

The present invention relates to a device for monitoring a sheet material in a conveying apparatus which is used in the field of photographic technology and which conveys sheet materials such as heat-sensitive materials and photosensitive materials e.g., photographic films and photographic paper, along a prescribed conveying path, and to a method for monitoring a sheet material by using the device.

2. Description of the Related Art

Conventionally, when sheet materials, for example, photosensitive materials such as photographic films, are conveyed along a prescribed conveying path, a combination of an infrared LED and a phototransistor (hereinafter, this combination is referred to as a "photosensor") is provided for each film size (film width), such that respective photosensors are disposed at positions corresponding to the edges of films of the various film sizes. The size of the film being conveyed is recognized by the detection of the film edge by the photosensor.

The film size can be recognized by using this method. However, when a film meanders, the phototransistor disposed at a position next to the "correct" position may detect the edge of the film such that a size different from the correct size is recognized.

The above problem occurs because the photosensors are not continuously arranged but are disposed at discrete positions along the edge-line of films. An increased number of phototransistors may be disposed without gaps therebetween to overcome this problem.

However, even when an increased number of phototransistors are disposed without gaps therebetween, the detection points which are detected by the phototransistors still remain as discrete points due to restrictions imposed by the shape of the phototransistor. Therefore, errors in recognition of film size cannot be eliminated completely.

SUMMARY OF THE INVENTION

In view of the aforementioned problems, an object of the present invention is to provide a device for monitoring a sheet material which can reliably recognize the position of an edge of a sheet material moving along a conveying path, and to provide a method of a monitoring a sheet material by using the device.

A first aspect of the present invention provides a device for monitoring a sheet material which device is used for a conveying apparatus for conveying sheet materials along a prescribed conveying path, said device comprising: a photoelectric conversion element which has a linear detecting area and outputs values which vary in accordance with an amount of light received at the detecting area, the amount of light changing due to the passage of a sheet material along the conveying path; and recognizing means which recognizes a position of a transverse direction end portion of the sheet material on the basis of a value output by the photoelectric conversion element.

In the first aspect of the present invention, a photoelectric conversion element which outputs a value which changes in accordance with the amount of light received at a linear detecting area is used. For example, the photoelectric conversion element is disposed along transverse direction of the sheet material. It is preferable that the light source and the photoelectric conversion element are disposed at opposite sides of the conveying path of the sheet material so that a prescribed amount of light is irradiated on to the entire detecting area of the photoelectric conversion element through the conveying path of the sheet material (a transmission-type arrangement). Alternatively, the light source and the photoelectric conversion element may be disposed at the same side of the conveying path of the sheet material (a reflection-type arrangement). In a preferable embodiment of the present invention, the transmission-type arrangement is used.

When the photoelectric conversion element and the light source are disposed in the transmission-type arrangement, a sheet material conveyed along the conveying path blocks a portion of the photoelectric conversion element. Therefore, when an edge of the sheet material moves, i.e., when the edge of the sheet material moves in the transverse direction, the output value changes, and the amount of the movement of the edge can be detected on the basis of the change in the output value.

When a plurality of sheet materials having different widths are conveyed along the same conveying path, the output value obtained during passage of a sheet material differs in accordance with the width of the sheet material. Therefore, it can be reliably recognized that a plurality of sheet materials having different widths are being conveyed along the route.

In the second aspect of the present invention, the width of the sheet material in a transverse direction and the type of the sheet material are recognized on the basis of the position of the transverse direction end portion of the sheet material which is recognized in the first aspect.

The position of the transverse direction end portion varies even when a single type of sheet material is conveyed. However, when a plurality of sheet materials having different widths are conveyed, the characteristic of the output value varies in accordance with the widths of the sheet materials.

Therefore, when a map showing relationships between output values and the widths of sheet materials is prepared in advance, the width and the type of a sheet material which is currently being conveyed can be automatically recognized.

In the third aspect of the present invention, the change in the amount of light received at the detecting area due to the passage of the sheet material along the conveying path is caused by the presence or absence, the number and the pitch of perforations formed in the sheet material, and the type of the sheet material is recognized from the presence or absence, the number and the pitch of the perforations.

Therefore, in accordance with the third aspect of the invention, the type of the sheet material which is currently being conveyed can be automatically recognized when a map showing relationships between output values and the presence or absence, the number and the pitch of perforations of sheet materials is prepared in advance.

In the fourth aspect of the present invention, the amount of meandering of the sheet material conveyed along the conveying path is recognized on the basis of the position of the transverse direction end portion of the sheet material.

In accordance with the fourth aspect of the invention, for example, when, on the basis of the position of the transverse direction end portion of the sheet material currently being conveyed on the conveying path, the current position of the end portion is found to be different from a reference position which is determined in advance, it can be recognized that the sheet material is meandering and that jamming may possibly occur. Thus, notification can be given quickly that the sheet material is meandering, or the conveying of the sheet material can be quickly stopped and automatically. Thus, deformation and breakage of the sheet material can be prevented.

In the fifth aspect of the present invention, the photoelectric conversion element is a position sensitive detector (PSD) which has a unidimensionally continuous detecting area formed by one half portion and another half portion which are separated at a central position of the PSD which is a reference position, and each half portion outputs an electric signal which corresponds to an amount of light received thereby.

In the fifth aspect of the invention, a plurality of sheet materials having different widths are conveyed along the conveying path in a manner such that the central line of each sheet material is disposed at the same position, and one end of the detecting area of the PSD is disposed at a position coinciding with the central lines of the sheet materials.

In this way, sheet materials having different widths can be discriminated from each other by the output values from the both ends of the PSD.

When the sheet materials are photographic films, even if the widths of the films are the same, if there are differences between the films such as perforations provided at predetermined pitches along the longitudinal direction of the films, the output values from the conveying direction center of the photographic film to the edge thereof are detected by the PSD, and thus, the films can be differentiated on the basis of the presence/absence of perforations or the like, and the types of the films can be determined.

The sixth aspect of the present invention provides a method for monitoring a sheet material which method is used for an apparatus for conveying sheet materials along a prescribed conveying path, said method comprising: a step of disposing, in a direction perpendicular to a direction of conveying of a sheet material, an element whose output value changes in accordance with an amount of light received at a linear detecting area thereof; and a step of detecting an amount of movement of an edge of the sheet material in a transverse direction of the sheet material on the basis of the change in the amount of light received.

In accordance with the sixth aspect of the invention, the output value changes in accordance with the received amount of light irradiated to the linear detecting area of the element. In other words, this element device has the same function as a hypothetical photosensor composed of an infinite number of linearly arranged photosensors each of which detects the light at a spot (point). The element device is disposed so as to extend over the edge of the sheet material which is conveyed along the prescribed conveying path. In other words, the element is disposed in a manner such that it extends over the edge of the sheet, and some portion of the liner detecting area thereof is located above the sheet. By disposing the element in this manner, the amount of movement of the sheet material in the transverse direction during conveying can be detected from the output value.

Thus, even minute fluctuations can be reliably detected when the movement of the sheet material is monitored to detect abnormal movements other than the normal movement (conveying) of the sheet material such as meandering. When a plurality of sheet materials having different widths are conveyed along the same conveying path, the sheet materials can be discriminated from each other. In accordance with this aspect of the present invention, the output value changes continuously in close accordance with the changes in the position of the edge. Thus, when a plurality of sheet materials having widths which are different from each other but close to each other are conveyed, the difference in the widths can be correctly detected without being affected by some degree of meandering.

BRIEF DESCRIPTION OF THE DRAWINGS

FIG. 4 is a map expressing the relation between the signal pattern stored in the controller and the film size.

DESCRIPTION OF THE PREFERRED EMBODIMENTS

Figure 1:
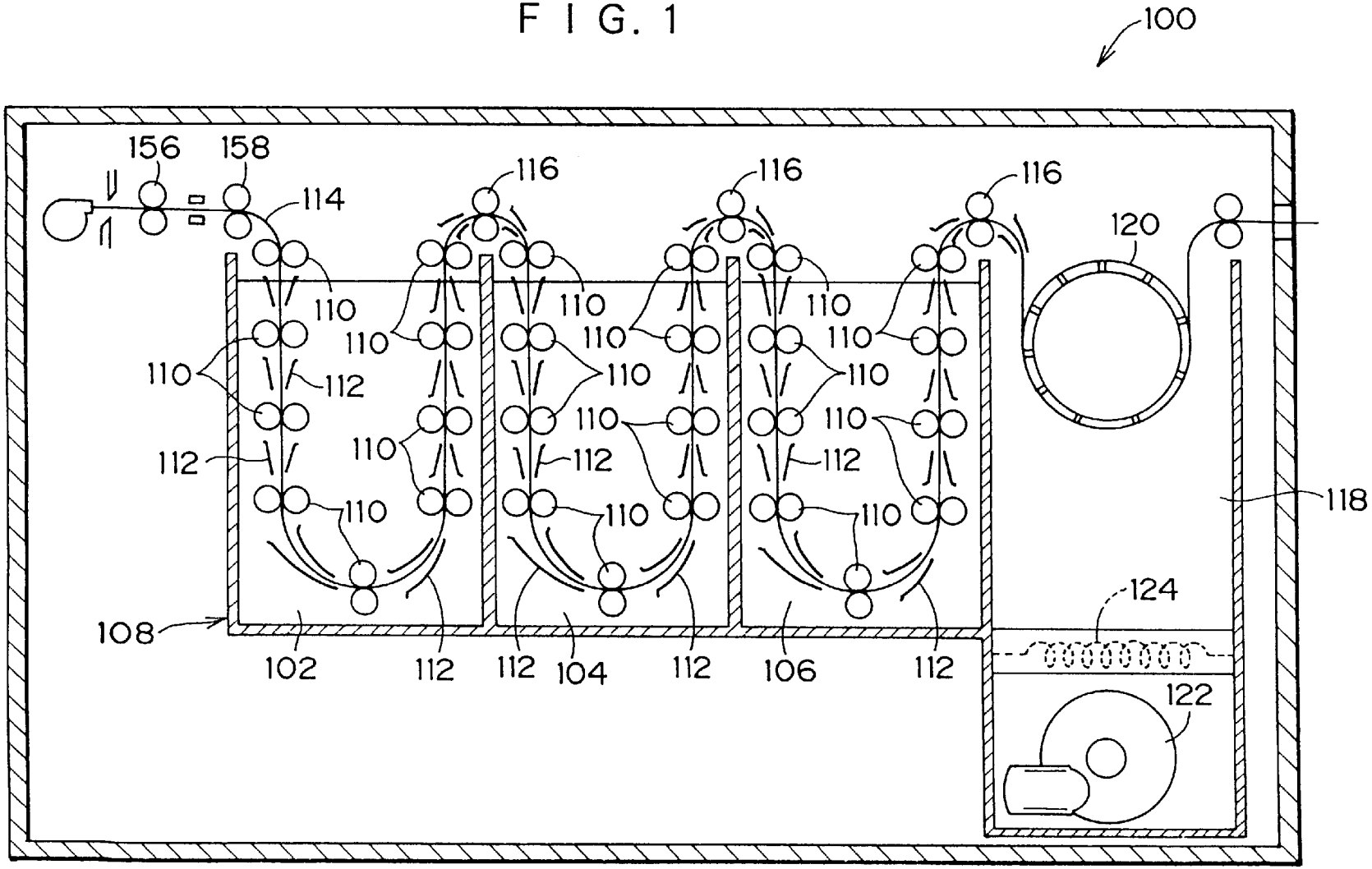
FIG. 1 is a schematic structural view of a film processor which contains the apparatus for monitoring a sheet material in accordance with a preferred embodiment of the present invention.

FIG. 1 shows a film processor 100 which contains the apparatus for monitoring a sheet material in accordance with the present embodiment.

A processing liquid tank 108 having a developing tank 102, a fixing tank 104 and a washing tank 106 with water is provided in the film processor 100. A processing rack is disposed in each tank of the processing liquid tank 108. The processing liquid tank 108 is not limited to the type described above. The processing liquid tank 108 may further have a developing and coloring tank, a bleaching and fixing tank, a rinsing tank, or the like. Or, a plurality of tanks containing the same processing liquid may be connected in series. The present embodiment can be applied various types of tanks.

The processing rack is formed of a plurality of pairs of conveying rollers 110 and guide plates 112 which are suspended between a pair of side plates (omitted in the figure). In this structure, a negative film 114 moves along a prescribed path while being transferred successively from one pair of conveying rollers 110 to the next pair of conveying rollers 110.

The plurality of pairs of conveying rollers 110 form a conveying path having a substantial U shape in each tank of the processing liquid tank 108.

Pairs of cross-over rollers 116 are disposed between tanks of the processing liquid tank 108 so that the negative film 114 is transferred from one tank to the next tank along a substantially inverse U-shaped path as shown in FIG. 1.

The pairs of conveyor rollers 10 are driven and rotated by driving force of a driving means (not shown) such that the negative film 114 is conveyed at a constant speed.

Thus, the negative film 114 enters into each of the developing tank 102, the fixing tank 104 and the washing tank 106 with water (starting at the developing tank 102) in a substantially vertical direction, makes a U-turn at the bottom portion of each tank, and exits in a substantially vertical direction. At portions between the development tank 102 and the fixing tank 104 and between the fixing tank 104 and the washing tank 106 with water, the film is transferred along a substantially inverse U-shaped path. Each processing (the developing, the fixing or the washing with water) is carried out while the film is immersed in the corresponding liquid.

The negative film 114, for which processing in the processing liquid tank 108 has been completed, is transferred to a drying section 118 and wound around a drying drum 120 having a hollow interior.

In the drying section 118, a flow of air generated by a fan 122 is heated by a heater 124 to form drying air, and the inside of the drying section 118 is filled with the drying air.

Within the drying drum 120, the drying air is supplied in the axial direction of the drum 120. A plurality of small holes (omitted from the figure) are formed on the circumferential surface of the drying drum 120 as outlets of the drying air supplied to the interior of the drying drum 120.

The outer surface of the negative film 114 is dried in the environment of the drying air, and the surface of the negative film 114 facing the drying drum 120 is dried by the drying air blowing out through the holes of the drying drum 120.

The negative film 114, for which drying has been completed in the drying section 118 and which has been discharged from the drying section 118, is left hanging at the exterior of the housing when a single negative film is processed. When the negative film 114 is a roll film formed by joining a plurality of negative films, the roll film is wound around an empty reel disposed downstream of the drying section 118. (These are all omitted from the figures.)

Figure 2:
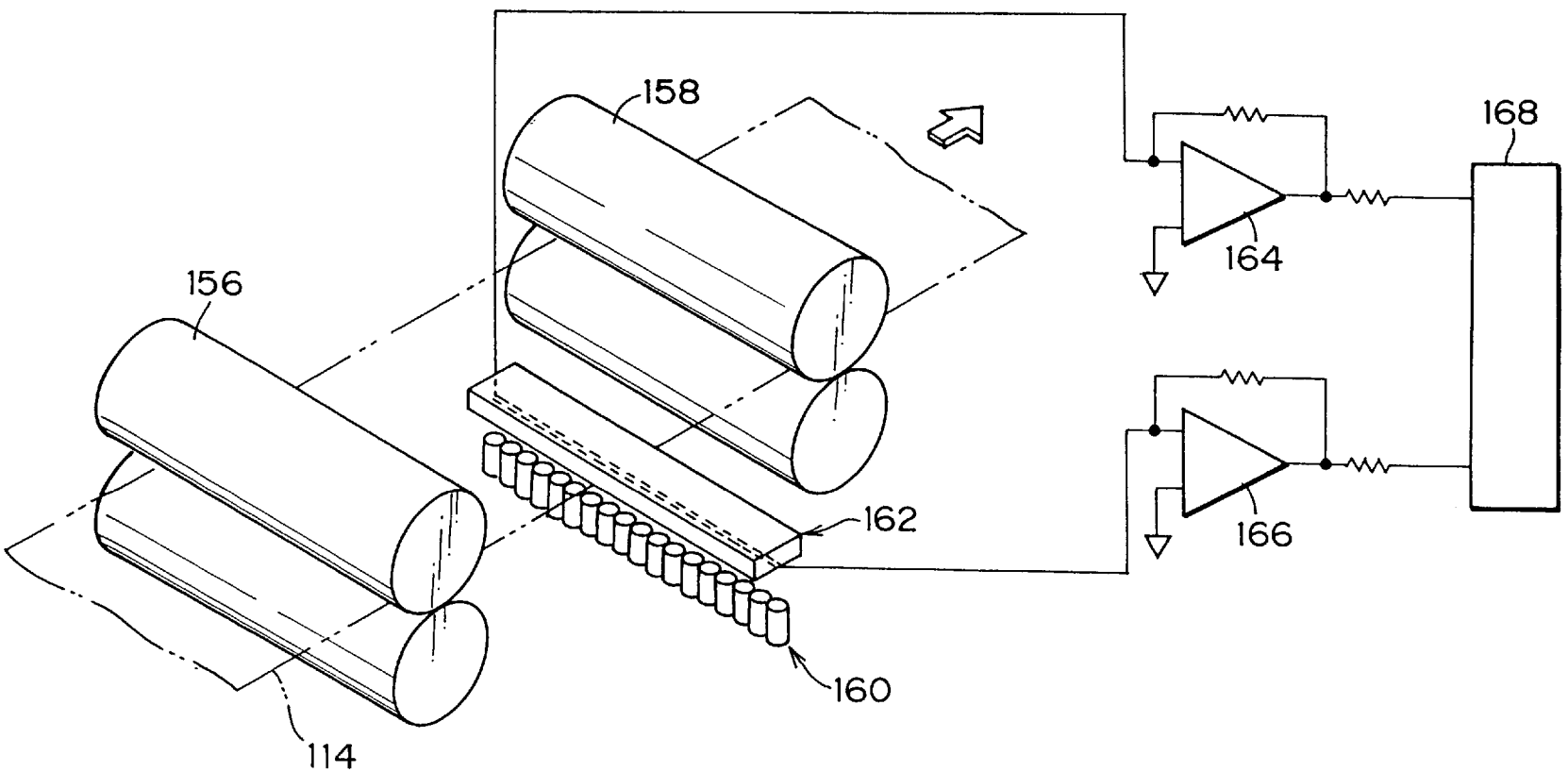
FIG. 2 is a PSD control block diagram containing a perspective view of the apparatus for monitoring a sheet material in accordance with the preferred embodiment which contains a PSD and is disposed in the vicinity of a loading portion of the film processor shown in FIG. 1.

FIG. 2 shows the device for monitoring a sheet material of the present invention which is disposed in the vicinity of the loading portion of the processor 100 along the conveying path of the undeveloped film 114 (or, when the film is a 135 film or an APS film, a portion of the negative film 114 in the vicinity of the loading portion in which the cartridge is loaded). In the arrangement of device for monitoring a sheer material shown in FIG. 2, two pairs of conveyor rollers 156 and 158 are disposed to convey the negative film in the horizontal direction. The conveying path of the film is shown by the arrow in FIG. 2.

An LED array 160 serving as a light source and a PSD (position sensitive detector) 162 serving as a photoelectric conversion element are disposed on opposite sides of the conveying path of the negative film 114 being conveyed in the horizontal direction in a manner such that the conveying path is disposed between the LED array 160 and the PSD 162.

The PSD 162 is equipped with a detecting portion (shown as the shaded area in FIG. 5) which can detect the amount of light unidimensionally (linearly). The central portion of the detecting portion in the longitudinal direction of the detecting portion is a reference position (0 level) which divides the PSD into a left half portion and a right half portion (refer to FIG. 5). The amount of light received by the left half portion of the PSD (the received amount varies in accordance with the degree of light-blocking due to the film sheet being conveyed) corresponds to signal A, and the amount of light received by the right half portion of the PSD (the received amount may vary for the same reason as above) corresponds to signal B. In short, the amount of electric current that flows in each half portion varies in accordance with the amount of light actually received by each portion, which amount may change due to light-blocking by the film.

The PSD 162 is disposed such that one end thereof is positioned at the central line of the conveying path. A plurality of negative films 114 having different widths are conveyed such that the central lines of the films are precisely aligned with the central line of the conveying path.

When a plurality of negative films 114 having different widths are developed, the rate of degradation of a processing liquid differs depending on the processed surface areas of the films. In other words, the greater the processed surface area, the faster the degradation of the processing liquid. Therefore, the width of the negative film 114 to be processed (the type of the negative film 114) must be accurately recognized in order to properly deal with the degradation of the processing liquid.

On the basis of the output current from the PSD 162, a controller 168 recognizes the type of the negative film 114, and mast efficiently and effectively determines an amount of replenishing solution to be replenished and a time when the replenishing solution is to be replenished, which amount and time depend on the degradation of the processing liquid.

The source of the light irradiated to the PSD 162 is the LED array 160. The output value of the PSD 162 is a maximum value when the negative film 114 is absent, and decreases depending on the area blocked by the negative film 114. Because the output value of the PSD 162 is minute, the end portions of the PSD 162 are connected to amplifiers 164, 166 for amplification. Hereinafter, the signal obtained from the left half portion having the end portion of the PSD 162 disposed at the central position of the film conveying route is referred to as signal A, and the signal obtained from the right half portion of the PSD 162 is referred to as signal B.

FIG. 3 shows examples of types of the negative films 114 which may be actually developed in the present embodiment. FIG. 3A shows a 110 film. This film has a width of about 10 mm. FIG. 3B shows an APS film (a 240 film). This film has a width of about 24 mm, and two perforations 170 are formed for every image frame. The perforations 170 are formed at positions in the vicinities of the end portions of each frame in the longitudinal direction of the film. Therefore, the perforations 170 are not formed at a uniform pitch.

Figure 3A:
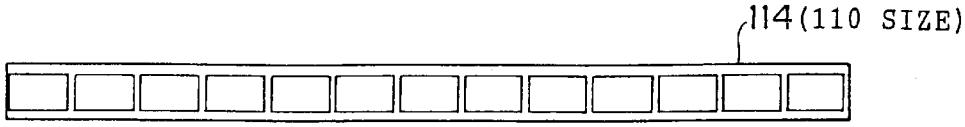
FIG. 3A is a plan view of a 110 film.
Figure 3B:
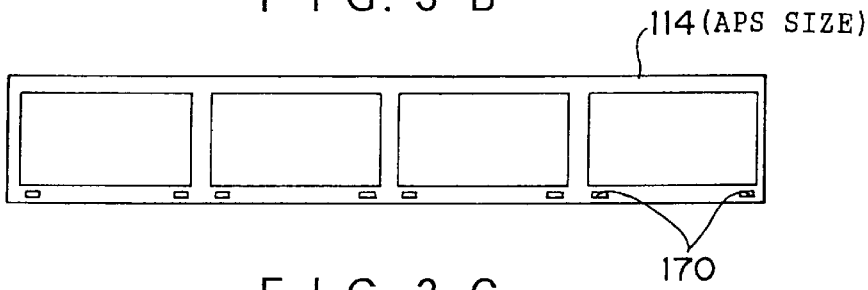
FIG. 3B illustrates an APS film.
Figure 3C:
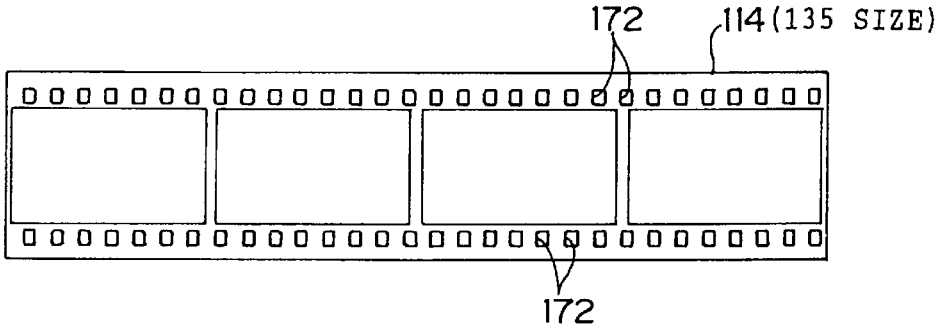
FIG. 3C illustrates a 135 film.

FIG. 3C shows a 135 film (a 35 mm film). This film has a width of about 35 mm and has a plurality of perforations 172 formed at a uniform pitch in both transverse direction end portions of the film.

Figure 3D:
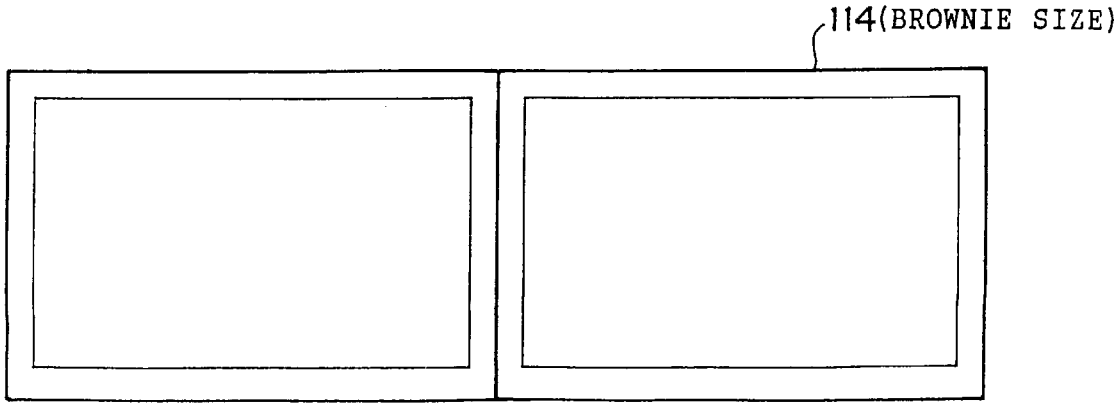
FIG. 3D illustrates a brownie size film used in the preferred embodiments of the present invention.

FIG. 3D shows a brownie size film (a 120 film). This film has a width of about 120 mm.

A film (a 126 film), which has the same width as the 135 film 114 (a 35 mm film) and no perforations, is also used although it is not shown in the figures. However, this type of film is rarely used and detailed description on this type of film is omitted in the present embodiment.

In the controller 168, a map 174 showing the relation between the size of the negative film 114 and the value of the input electric current is stored in advance, as shown in FIG. 4.

Figure 5A:
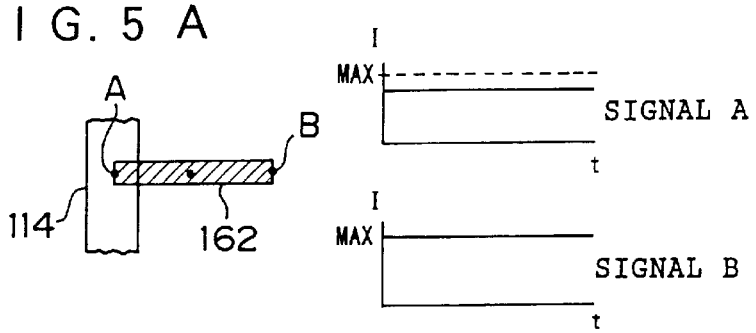
FIGS. 5A to 5D show signal patterns for the film sizes of the films shown in FIGS. 3A to 3D, respectively.

As shown in FIG. 2, the negative film 114 and the PSD 162 are disposed such that the edge of the left half portion (a detecting area) of the PSD 162 is aligned with the central line of the negative film 114. Therefore, the signal A which is output from this left half portion will be as follows:

(1) 110 film: the output value is constant and close to the maximum value (refer to signal A in FIG. 5A).

Figure 5B:
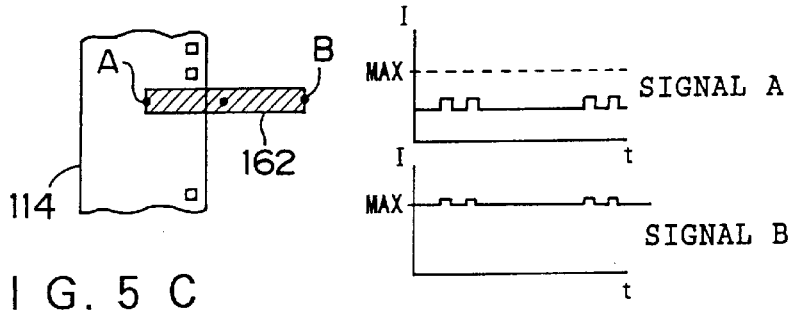

(2) 240 film: the output value is about one half of the maximum value and somewhat increases when a perforation 170 passes (refer to signal A in FIG. 5B).

Figure 5C:
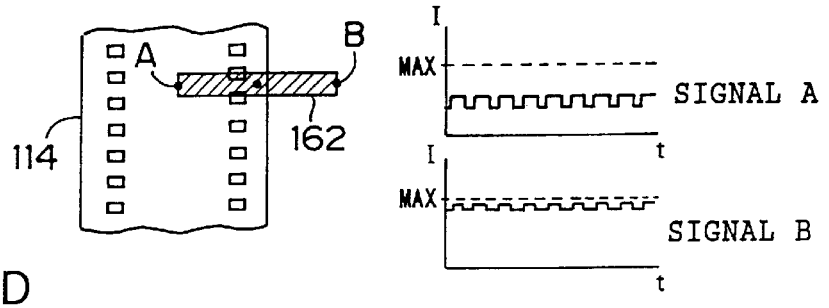

(3) 135 film: the output value is about one half of the maximum value and somewhat increases when a perforation 172 passes (refer to signal A in FIG. 5C).

Figure 5D:
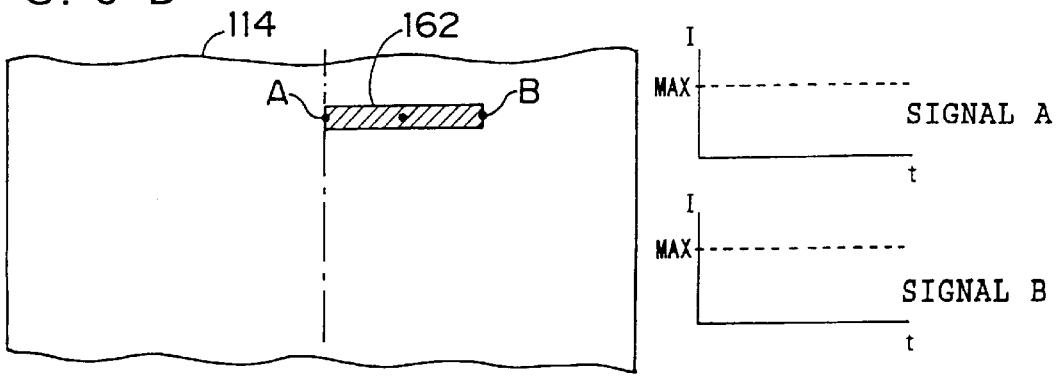

(4) 120 film: the output value is about 0 (refer to signal A in FIG. 5D).

The signal outputted from the opposite end (the right half) portion of the PSD 162 will be as follows:

(5) 110 film: the output value is constant and is substantially the maximum value (refer to signal B in FIG. 5A).

(6) 240 film: the output value is close to the maximum value and becomes the maximum value when a perforation 170 passes (refer to signal B in FIG. 5B).

(7) 135 film: the output value is constant and close to the maximum value (refer to signal B in FIG. 5C).

(8) 120 film: the output value is substantially 0 (refer to signal B in FIG. 5D).

As can be seen from the above output characteristics, each type of film exhibits a respectively different characteristic, and the controller can reliably recognize the type of the negative film 114 from the pattern of the output value (the output characteristic).

Next, operation in the present embodiment will be described hereinafter.

At a prescribed position of the film processor 100, an undeveloped film such as a 135 film or an APS film is loaded together with a cartridge, and a negative film 114 is pulled out.

The pulled out film 114 is immersed in the processing liquid tank 108, i.e., in the developing tank 102, the fixing tank 104 and the washing tank 106 with water, successively, to develop the film. The negative film 114 having developed images is wound around the drying drum 120 in the drying section 118. The wound film is dried by the drying air blowing out from the interior of the drying drum 120 and by the atmosphere of the drying section 118 (which is heated for drying). The film is then discharged.

Each processing liquid deteriorates to a degree which depends on the surface area of the films processed in the processing liquid tank 108. In other words, when a film having a greater width and a film having a smaller width are processed, the film having the greater width degrades the processing liquid to a greater degree than the film having the smaller width does.

In order to deal with the degradation of the processing liquid in a most efficient and effective manner, the width of the processed negative film must be accurately recognized. In the present embodiment, the PSD 162 and the light source 160 are disposed in a vicinity of the loading portion (between the two pairs of the conveying rollers 156 and 158) such that the conveying path of the negative film is disposed between the PSD 162 and the light source 160. The size of the negative film 114 to be developed is recognized from the amount of light received by the PSD 162.

Figure 6:
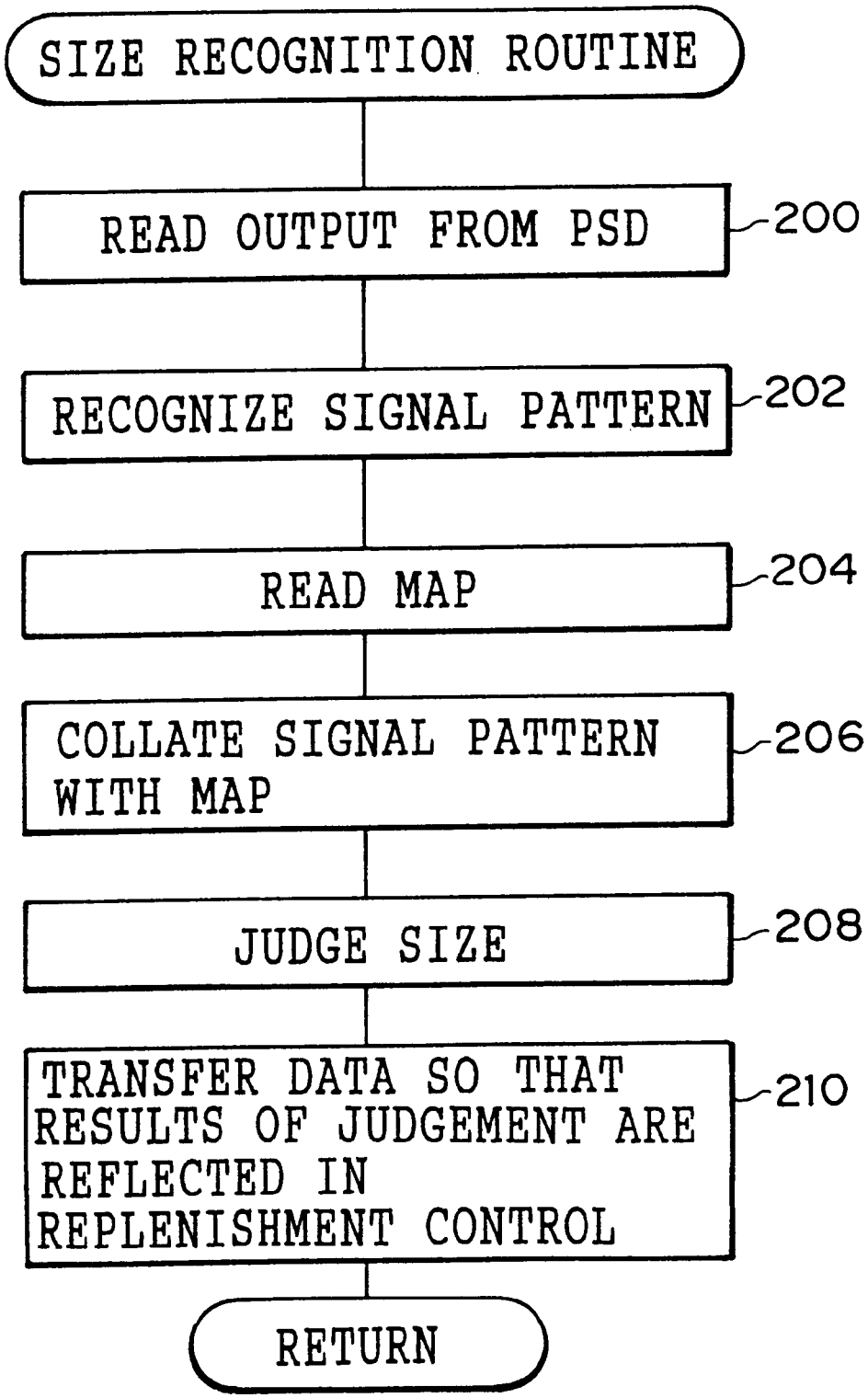
FIG. 6 is a control flow chart showing a size recognition routine using the PSD.

The control of recognition of the negative film will be described hereinafter with reference to the flowchart shown in FIG. 6. When development processing of one negative film is to be started, this routine is implemented upon instruction from the main flow of the program which controls operation of the film processor 100.

In step 200, the output value from the PSD 162 is read. The results of reading consist of two signals because an output value comes from each half portion of the PSD 162. The signal pattern (refer to FIGS. 5A through 5D) is recognized from this pair of signals (step 202).

In the next step 204, the map 174 (refer to FIG. 4) which has been stored in advance is read. In step 206, the signal pattern read above is collated with the map.

For example, when the results of collation reveal that signal A and B of the detected signal pattern match the signal patterns shown in FIG. 5C (refer to above (3) and (7)), it is recognized that the negative film to be developed is a 135 film (step 208), and in the next step 210, the data is transferred to the controller so that the data can be used for controlling replenishment. The recognized size may be displayed.

In accordance with the present embodiment, a plurality of sizes can be recognized by a single PSD 162. In accordance with the conventional method, photosensors are placed at discrete positions along the transverse direction of the sheet with predetermined intervals there between. In contrast, in accordance with the method of the present embodiment, the PSD 162 is constructed such that detection is effected along a continuum along the transverse direction of the negative film without gaps. Therefore, the size of the negative film 114 can be reliably recognized even if the negative film 114 meanders somewhat while being conveyed.

The routine for recognizing the size of the negative film 114 to be developed has been described above. However, it is also possible to implement a routine for detecting and controlling meandering simultaneously with the above routine. Such a routine for detecting and controlling meandering may be started when a change of certain extent or larger occurs in the output values from the PSD 162. More specifically, when the type of the film being conveyed has been identified by the size-recognizing routine and thus the output amplitude to be detected by the PSD 162 has been determined (predicted) for the particular film, if the detected output value exceeds the expected amplitude of electric current, it is judged that meandering is taking place, possibly caused by jamming, and a suitable measure such as the sounding of an alarm may be taken. Thus, damage to and breakage of the negative film due to jamming can be prevented.

As described above, the present invention exhibits an excellent effect in that the position of an edge of a sheet material moving along a conveying path can reliably be recognized.

The edge of one of the end portions of the detecting area of the photoelectric conversion element is aligned with a reference position of each sheet material. The reference position, (for example, is the central position of each sheet material when the sheet materials are conveyed by using the central line thereof as the reference position). Thus, various types of sheet materials having different widths can be discriminated from each other.

In addition, meandering even at minute levels can be reliably detected because the photoelectric conversion element of the present invention has a linearly continuous detection area which allows for detection of very subtle changes in the edge position of the film which may occur during slight meandering of the film.

What is claimed is:

1. A device for monitoring a sheet material as said sheet material is conveyed along a prescribed conveying path, said device comprising:

a photoelectric conversion element which has a linear detecting area and outputs a value which varies in accordance with an amount of light received at the detecting area, the amount of light changing due to the passage of a sheet material along the conveying path; and recognizing means which recognizes a position of a transverse direction end portion of the sheet material on the basis of a value output by the photoelectric conversion element;

wherein the change in the amount of light received at the detecting area due to the passage of the sheet material along the conveying path is caused by the presence or absence, the number and the pitch of perforations formed in the sheet material, and a type of the sheet material is recognized from the presence or absence, the number and the pitch of the perforations.

2. A device for monitoring a sheet material as said sheet material is conveyed along a prescribed conveying path, said device comprising:

a photoelectric conversion element which has a linear detecting area and outputs a value which varies in accordance with an amount of light received at the detecting area, the amount of light changing due to the passage of a sheet material along the conveying path; and recognizing means which recognizes a position of a transverse direction end portion of the sheet material on the basis of a value output by the photoelectric conversion element;

wherein an amount of meandering of the sheet material conveyed along the conveying path is recognized on the basis of the position of the transverse direction end portion of the sheet material.

3. A device for monitoring a sheet material according to claim 2, wherein said device further comprises an alarm device, and when the amount of meandering of the sheet material exceeds a prescribed range, said device judges that the sheet material is meandering and activates the alarm device.

4. A device for monitoring a sheet material according to claim 2, which further comprises an automatic stopping device which stops conveying of the sheet material, and when the amount of meandering of the sheet material exceeds a prescribed range, said device for monitoring a sheet mater judges that the sheet material is meandering and activates the automatic stopping device.

5. A device for monitoring a sheet material as said sheet material is conveyed along a prescribed conveying path, said device comprising:

a photoelectric conversion element which has a linear detecting area and outputs a value which varies in accordance with an amount of light received at the detecting area, the amount of light changing due to the passage of a sheet material along the conveying path; and recognizing means which recognizes a position of a transverse direction end portion of the sheet material on the basis of a value output by the photoelectric conversion element;

wherein said device further comprises a map in which relationships between output values from the photoelectric conversion element and widths of sheet materials are stored.

6. A device for monitoring a sheet material according to claim 5, wherein the width and a type of the sheet material are recognized by collating the values output by the photoelectric conversion element with the map.

7. A device for monitoring a sheet material as said sheet material is conveyed along a prescribed conveying path, said device comprising:

a photoelectric conversion element which has a linear detecting area and outputs a value which varies in accordance with an amount of light received at the detecting area, the amount of light changing due to the passage of a sheet material along the conveying path; and recognizing means which recognizes a position of a transverse direction end portion of the sheet material on the basis of a value output by the photoelectric conversion element;

wherein the photoelectric conversion element is a position sensitive detector (PSD) which has a unidimensionally continuous detecting area formed by one half portion and another half portion which are separated at a central position of the PSD which is a reference position, and each half portion outputs an electric current which corresponds to an amount of light received thereby; and wherein the edge of the one half portion of the detecting area of the photoelectric conversion element is disposed at a position coinciding with a reference position of each sheet material.

8. A device for monitoring a sheet material according to claim 7, wherein the reference position of the sheet material is a central position of each sheet material in a transverse direction of the sheet material which is perpendicular to a direction of conveying of the sheet material.

9. A device for monitoring a sheet material according to claim 7, wherein an electric current outputted from the one half portion of the detecting area of the photoelectric conversion element disposed at the position coinciding with the reference position of each sheet material and an electric current outputted from the other half portion of the detecting area of the photoelectric conversion element are paired-current signal outputs.

10. A device for monitoring a sheet material according to claim 9, wherein said device comprises a map in which relationships between the paired-current signal outputs and widths of sheet materials are stored.

11. A device for monitoring a sheet material according to claim 10, wherein the width and a type of the sheet material are recognized by collating the detected paired-current signal outputs with the map.

12. A device for monitoring a sheet material as said sheet material is conveyed along a prescribed conveying path, said device comprising:

a photoelectric conversion element which has a linear detecting area and outputs a value which varies in accordance with an amount of light received at the detecting area, the amount of light changing due to the passage of a sheet material along the conveying path; and recognizing means which recognizes a position of a transverse direction end portion of the sheet material on the basis of a value output by the photoelectric conversion element;

wherein an LED array is used as a light source.

13. A device for monitoring a sheet material according to claim 12, wherein the light source and the photoelectric conversion element are disposed at opposite sides of the conveying path of the sheet material so that a prescribed amount of light is irradiated to the entire detecting area of the photoelectric conversion element.

14. A device for monitoring a sheet material according to claim 12, wherein the light source and the photoelectric conversion element are disposed at the same side of the conveying path of the sheet material.

15. The device for monitoring a sheet material according to claim 12, wherein the LED array is arranged in a linear manner in a direction which is perpendicular to a direction in which the sheet material is conveyed.

16. A method for monitoring a sheet material which method is used for an apparatus for conveying sheet materials along a prescribed conveying path, said method comprising:

a step of disposing, in a direction perpendicular to a direction of conveying of a sheet material, an element whose output value changes in accordance with an amount of light received at a linear detecting area thereof; and a step of detecting an amount of movement of an edge of the sheet material in a transverse direction of the sheet material on the basis of the change in the amount of light received.

17. A method for monitoring a sheet material according to claim 16, further comprising:

a step of disposing the edge of one half portion of the detecting area of the element at a position which coincides with a reference position of the sheet material;

a step of using, as paired outputs, an output value from the one half portion of the detecting area of the element disposed at the position which coincides with the reference position of the sheet material and an output value from the other half portion of the detecting area of the element;

a step of forming a map in which relationships between the paired outputs and widths of sheet materials are stored; and a step of, when the paired outputs are detected, collating the detected paired outputs with the map so as to recognize the width and a type of the sheet material from which the paired outputs are obtained.

18. A method for monitoring a sheet material according to claim 17, wherein the step of disposing the edge of one half portion of the detecting area of the element at the position which coincides with the reference position of the sheet material comprises a step of disposing the edge of the one half portion of the element at a transverse direction central position of the sheet material.

* * * * *